US007079080B2

(12) United States Patent
Mizuno et al.

(10) Patent No.: US 7,079,080 B2
(45) Date of Patent: Jul. 18, 2006

(54) CIRCULARLY POLARIZED ANTENNA AND RECTENNA USING THIS ANTENNA

(75) Inventors: Tomohiro Mizuno, Tokyo (JP); Hiroyuki Satoh, Tokyo (JP); Hirokatsu Okegawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 2 days.

(21) Appl. No.: 10/971,141

(22) Filed: Oct. 25, 2004

(65) Prior Publication Data

US 2005/0259030 A1 Nov. 24, 2005

(30) Foreign Application Priority Data

May 24, 2004 (JP) ..... 2004-153510

(51) Int. Cl.
*H01Q 1/38* (2006.01)
*H01Q 7/00* (2006.01)

(52) U.S. Cl. ..... 343/700 MS; 343/866; 343/741

(58) Field of Classification Search ..... 343/700 MS, 343/866, 867, 850, 865, 741
See application file for complete search history.

(56) References Cited

U.S. PATENT DOCUMENTS 4,980,693 A * 12/1990 Wong et al. ..... 343/700 MS
5,005,019 A * 4/1991 Zaghloul et al. ..... 343/700 MS
5,714,965 A * 2/1998 Taguchi ..... 343/866
5,973,644 A * 10/1999 Haneishi et al. ..... 343/700 MS
6,885,342 B1 * 4/2005 Saegrov et al. ..... 343/700 MS
2002/0071399 A1 6/2002 Smith ..... 370/278

FOREIGN PATENT DOCUMENTS

JP 5-110334 4/1993
WO WO 00/64004 10/2000

OTHER PUBLICATIONS

Hua-Ming Chen, "A Circular Polarized Annular Ring Microstrip Antennas." Antennas and Propagation Society International Symposium, 1998., IEEE, vol. 3, XP-010292089, Jun. 21, 1998, pp. 1352-1355.
Berndie Strassner, et al., "5.8 GHz circular polarized rectenna for microwave power transmission." Energy Conversion Engineering Conference Conference and Exhibit, 2000. vol. 2, XP-010513003, Jul. 24, 2000, pp. 1458-1468.

(Continued)

*Primary Examiner*—Hoang V. Nguyen
(74) *Attorney, Agent, or Firm*—Oblon, Spivak, McClelland, Maier & Neustadt, P.C.

(57) ABSTRACT

A loop antenna unit (2), a balanced line (3), and two perturbation elements (4) are formed on a dielectric board (1) by using manufacturing methods, such as printing and etching. The loop antenna unit (2) is formed along the circumference of a circle, and is connected to the balanced line (3). Each of the two perturbation elements (4) is a member in the shape of a tooth which is inclined 45 degrees against a direction of feeding of power via the balanced line (3) and which is projecting from the loop antenna unit (2) in an inward direction toward the center of the loop antenna unit (2). The two perturbation elements (4) are arranged at two opposite points in the loop antenna unit (2) so that they are opposite to each other.

12 Claims, 9 Drawing Sheets

OTHER PUBLICATIONS

Jouko Heikkinen, et al., "Low-profile circularly polarized rectifying antenna for wireless power transmission at 5.8 GHz." IEEE Microwave and Wireless Components Letters, IEEE Service Center, vol. 14, No. 4, XP-001195792, Apr. 2004, pp. 162-164.

Berndie Strassner et al., "Highly efficient c-band circularly polarized rectifying antenna array for wireless microwave power transmission." IEEE Transactions on Antennas and Propagation, vol. 51, No. 6, XP-001166458, Jun. 2003, pp. 1347-1356.

Kin-Lu Wong, et al., "Printed Ring Slot Antenna for Circular Polarization." IEEE Transactions on Antennas and Propagation, vol. 50, No. 1, XP-001102260, Jan. 2002, pp. 75-79.

* cited by examiner

CIRCULARLY POLARIZED ANTENNA AND RECTENNA USING THIS ANTENNA

BACKGROUND OF THE INVENTION

1. Field of the Invention

The present invention relates to a circularly polarized antenna that receives a circularly-polarized microwave transmitted thereto, and rectifies the received microwave so as to produce electric power, and a rectenna using the circularly polarized antenna.

2. Description of Related Art

For example, Japanese patent application publication No. 5-110,334 discloses the structure of a prior art circularly polarized antenna element. The antenna disclosed by this patent application publication is provided with a ground conductor disposed on a back surface of a dielectric board, a ring patch antenna having perturbation elements on a surface thereof, and a power feeding conductor pattern that is so placed as not to be in contact with the ring patch antenna, and is so constructed as to supply electric power to the power feeding conductor pattern from the back side of the dielectric board. The prior art antenna element can form a radiation field by means of the ring patch antenna and the ground conductor by supplying electric power to the power feeding conductor pattern, and can create circularly-polarized-wave radiation by virtue of the operations of the perturbation elements.

[Patent reference 1] Japanese patent application publication No. 5-110,334.

In the antenna element disclosed in Japanese patent application publication No. 5-110,334, it is necessary to make sure that the dielectric board has a certain thickness or more in order to maintain the characteristics of the radiation field formed by the ring patch and the ground conductor. Japanese patent application publication No. 5-110,334 discloses a case where the dielectric board has a thickness B=1.3 mm, as an example. A problem with the prior art antenna element is that it is difficult to make the thickness of the dielectric board thin because the prior art antenna element has a ground conductor. Another problem is that the thickness of the whole of the prior art antenna element increases because electric power must be supplied to the power feeding conductor pattern from the back side of the dielectric board.

SUMMARY OF THE INVENTION

The present invention is made in order to solve the above-mentioned problems, and it is therefore an object of the present invention to provide a circularly polarized antenna that can create circularly-polarized-wave radiation even if the thickness of a board thereof is thinned, and that can receive and rectify microwaves space transmitted thereto so as to produce electric power, and a rectenna using the circularly polarized antenna.

In accordance with an aspect of the present invention, there is provided a circularly polarized antenna including: a dielectric board; a balanced line formed on a surface of the dielectric board; a loop antenna unit disposed on the surface of the dielectric board, formed in a shape of a loop, and connected to the balanced line; and two perturbation elements each of which is formed in a shape of a tooth and is projecting from the loop antenna unit in an inward direction toward a center of the loop antenna unit, the two perturbation elements being arranged opposite to each other.

In accordance with another aspect of the present invention, there is provided a circularly polarized antenna including: a dielectric board; a balanced line formed on a surface of the dielectric board; a loop antenna unit disposed on the surface of the dielectric board, formed in a shape of a loop, and connected to the balanced line; and two perturbation elements each of which is formed in a shape of a crank and is projecting from the loop antenna unit in an outward direction, the two perturbation elements being arranged opposite to each other.

In accordance with a further aspect of the present invention, there is provided a circularly polarized antenna including: a dielectric board; a balanced line formed on a surface of the dielectric board; a loop antenna unit disposed on the surface of the dielectric board, formed in a shape of a loop, and connected to the balanced line; two first perturbation elements each of which is formed in a shape of a tooth and is projecting from the loop antenna unit in an inward direction, the two first perturbation elements being arranged opposite to each other; and two second perturbation elements each of which is formed in a shape of a crank and is projecting from the loop antenna unit in an outward direction, the two second perturbation elements being arranged opposite to each other.

In accordance with the above-mentioned aspects of the present invention, since the circularly polarized antenna is formed without providing any ground conductor on the back surface of the dielectric board, the structure of the circularly polarized antenna can be simplified and productivity can be increased. Furthermore, when the dielectric board is a thin-film board, the weight of the circularly polarized antenna can be reduced.

In accordance with a still further aspect of the present invention, there is provided a rectenna element including: a dielectric board; a loop antenna unit disposed on the dielectric board and formed in a shape of a loop; two perturbation elements disposed in the loop antenna unit so that they are opposite to each other; and a rectifier circuit disposed on the dielectric board, for rectifying RF electric power received by the loop antenna unit.

In accordance with this aspect of the present invention, since the rectenna element that receives and rectifies a circularly-polarized wave is formed without providing any ground conductor on the back surface of the dielectric board, the structure of the rectenna element can be simplified and productivity can be increased. Furthermore, when the dielectric board is a thin-film board, the weight of the rectenna element can be reduced.

In accordance with another aspect of the present invention, there is provided a rectenna including: a dielectric board; a plurality of rectenna elements each including a loop antenna unit disposed on the dielectric board and formed in a shape of a loop, two perturbation elements disposed in the loop antenna unit so that they are opposite to each other, and a rectifier circuit disposed on the dielectric board, for rectifying RF electric power received by the loop antenna unit; and a combining circuit having a strip line that connects positive inputs of the rectifier circuits of the plurality of rectenna elements with one another, and another strip line that connects negative inputs of the rectifier circuits of the plurality of rectenna elements with one another, for connecting the plurality of rectenna elements in parallel with one another.

In accordance with a further aspect of the present invention, there is provided a rectenna including: a dielectric board; a plurality of rectenna elements each including a loop antenna unit disposed on the dielectric board and formed in a shape of a loop, two perturbation elements disposed in the loop antenna unit so that they are opposite to each other, and a rectifier circuit disposed on the dielectric board, for rectifying RF electric power received by the loop antenna unit; and a combining circuit for connecting the rectifier circuits of the plurality of rectenna elements in series.

In accordance with the above-mentioned aspects of the present invention, since the rectenna that receives and rectifies circularly-polarized waves is formed without providing any ground conductor on the back surface of the dielectric board, the structure of the rectenna can be simplified and productivity can be increased. Furthermore, when the dielectric board is a thin-film board, the weight of the rectenna can be reduced.

Further objects and advantages of the present invention will be apparent from the following description of the preferred embodiments of the invention as illustrated in the accompanying drawings.

DETAILED DESCRIPTION OF THE PREFERRED EMBODIMENTS

Embodiment 1

Figure 1A:
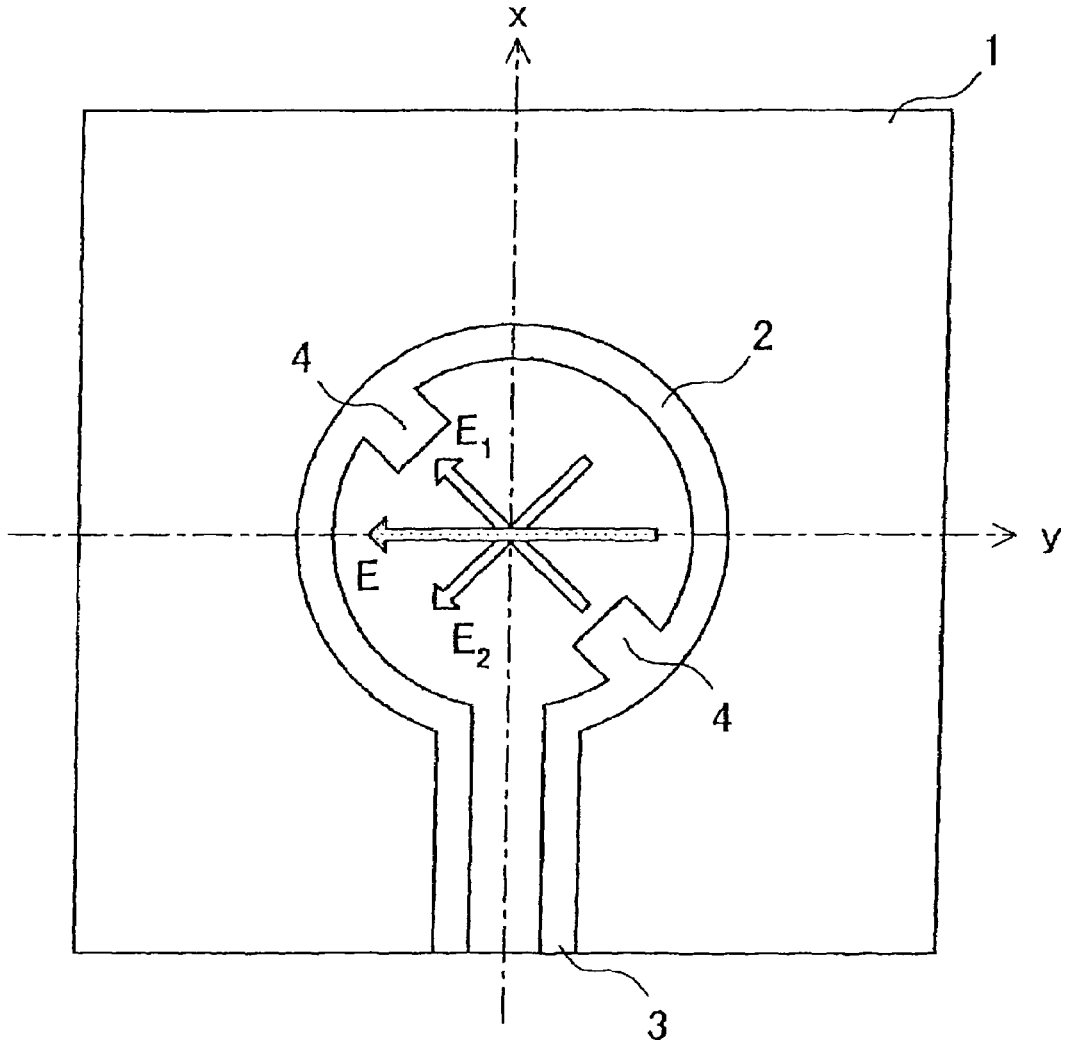
FIGS. 1A and 1B are a front view and a cross-sectional view showing the structure of a circularly polarized antenna in accordance with embodiment 1 of the present invention.
Figure 1B:
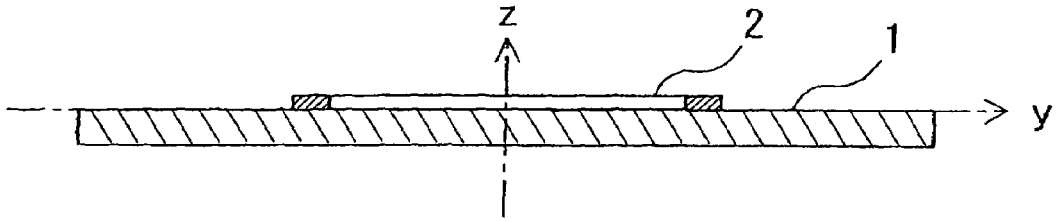

A circularly polarized antenna in accordance with embodiment 1 of the present invention will be explained with reference FIGS. 1 to 5. FIGS. 1A and 1B are views showing the structure of the circularly polarized antenna in accordance with embodiment 1 of the present invention. FIG. 1A is a front view of the circularly polarized antenna, and FIG. 1B is a cross-sectional view of the circularly polarized antenna. In FIG. 1A, reference numeral 1 denotes a dielectric board, reference numeral 2 denotes a loop antenna, reference numeral 3 denotes a balanced line, and reference numeral 4 denotes a perturbation element. The loop antenna unit 2, the balanced line 3, and two perturbation elements 4 are formed on the dielectric board 1 by using manufacturing methods, such as printing and etching. The loop antenna unit 2 is formed along the circumference of a circle, and is connected to the balanced line 3. Each of the two perturbation elements 4 is a member in the shape of a tooth which is inclined 45 degrees against a power feeding direction in which electric power is fed into the loop antenna unit 2 via the balanced line 3 (i.e., the direction of the X-axis), and which is projecting from the loop antenna unit 2 in an inward direction toward the center of the loop antenna unit 2. The two perturbation elements 4 are arranged at two opposite points in the loop antenna unit 2 so that they are opposite to each other. As shown in FIG. 1B, no ground conductor is formed on the back surface of the dielectric board 1, and the loop antenna unit 2, the balanced line 3, and the two perturbation elements 4 are formed only on the front surface of the dielectric board 1.

Thus, no ground conductor is formed on the back surface of the dielectric board 1, and the loop antenna unit 2, the balanced line 3, and the two the perturbation elements 4 are formed only on the front surface of the dielectric board 1 so that electric power is fed into the loop antenna unit 2 via the balanced line 3. As a result, the structure of the circularly polarized antenna can be simplified and productivity can be increased. A board having a thickness of several mm, which is usually used, can be used as the dielectric board 1. As an alternative, a thin-film board with a thinner thickness can be used as the dielectric board 1. The thin-film board can have a thickness ranging from dozens to hundreds of micrometers. In a prior art circularly polarized antenna element, since a ground conductor is disposed and a radiation field caused by the ground conductor and a ring patch antenna is used, sufficient radiation field characteristics (radiant efficiency etc.) cannot be provided when the thickness of the dielectric board is made thin. In contrast, in accordance with embodiment 1 of the present invention, since no relationship between the circularly polarized antenna and any ground conductor is provided, the thickness of the dielectric board 1 can be thinned to the thinnest manufacturable one.

For example, in the case of a prior art patch antenna having a ground conductor, it is necessary to set a $B/\lambda$ value to about 0.02 or more in order to make the radiant efficiency be 90%. Concretely, it is necessary to set B=1.2 mm or more for a C band (about 5 GHz) and to set B=0.8 mm or more for an X band (about 7.5 GHz), where B is the thickness of the dielectric board and $\lambda$ is the wavelength of a microwave received by the circularly polarized antenna. Therefore, when the film thickness of the dielectric board is 1 mm or less (to be more specific, it is 1.2 mm or less for the C band and is 0.8 mm or less for the X band), the radiant efficiency of the prior art patch antenna having a ground conductor becomes 90% or less and therefore its characteristics degrade, whereas such characteristics degradation does not arise theoretically in the circularly polarized antenna in accordance with the present invention.

In the case of the prior art patch antenna having a ground conductor, it is further necessary to make the $B/\lambda$ value to about 0.006 or more in order to make the radiant efficiency be 60%, and therefore B=0.36 mm or more has to be set for the C band and B=0.24 mm or more has to be set for the X band. Therefore, when the film thickness of the dielectric board is about 0.3 mm or less (to be more specific, it is 0.36 mm or less for the C band and is 0.24 mm or less for the X band), the radiant efficiency of the prior art patch antenna having a ground conductor becomes 60% or less and therefore its characteristics degrade, whereas such characteristics degradation does not arise theoretically in the circularly polarized antenna in accordance with the present invention.

On the other hand, it can be assumed that the dielectric board needs to have a film thickness B of about 0.02 mm or more so that no harmful deformation, such as rupture and heat deformation, occurs in the circularly polarized antenna in accordance with the present invention. As can be seen from the above description, the film thickness of the dielectric board of the circularly polarized antenna in accordance with the present invention can be set to 0.02 mm to 0.3 mm (this upper limit of 0.3 mm changes depending upon bands) when the radiant efficiency is set to 60% or more, and can be set to 0.02 mm to 1 mm (this upper limit of 1 mm changes depending upon bands) when the radiant efficiency is set to 90% or more. In this case, the circularly polarized antenna in accordance with the present invention can have better radiation characteristics as compared with the prior art patch antenna having a ground conductor and the same film thickness as the circularly polarized antenna in accordance with the present invention.

When no perturbation element 4 is disposed, the electric field caused by the loop antenna has a direction shown by an arrow E, as shown in FIG. 1A. In accordance with this embodiment 1, the provision of the two perturbation elements 4 in the loop antenna unit 2 causes an electric field having two components E1 and E2. As a result, circularly-polarized-wave radiation can be created. By properly setting the size and width of each of the two perturbation element 4, the size (i.e., the height of each tooth-shaped member) being defined with respect to the inward direction toward the center of the loop antenna unit 2, the two components E1 and E2 can become equal and can have a phase difference of 90 degrees between them.

The thus-formed circularly polarized antenna can be thinned, as mentioned above, and a weight reduction of the circularly polarized antenna can be also achieved. That is, when the dielectric board 1 of the circularly polarized antenna in accordance with the present invention has a thickness of 0.1 mm, for example, the weight of the circularly polarized antenna can be reduced to 1/10 of that of a prior art circularly polarized antenna including a ground conductor and a dielectric board having of a thickness of 1 mm by only making a comparison between the weight of the dielectric board 1 and that of the dielectric board of the prior art circularly polarized antenna. Furthermore, since no ground conductor is disposed in the circularly polarized antenna in accordance with the present invention, the weight of the circularly polarized antenna can be accordingly reduced. It can be expected that this circularly polarized antenna is applied to a rectenna (i.e., an antenna equipped with a rectifier circuit: RECTIFYING ANTENNA), which will be mentioned later, for receiving and rectifying a microwave space transmitted thereto so as to produce electric power. The thinning of the circularly polarized antenna is very effective at achieving weight reduction in the whole of the rectenna when the rectenna has a large-area opening. For example, the thinning of the circularly polarized antenna makes it possible to secure the rectenna to a wall of a structure such as an existing building.

Figure 2A:
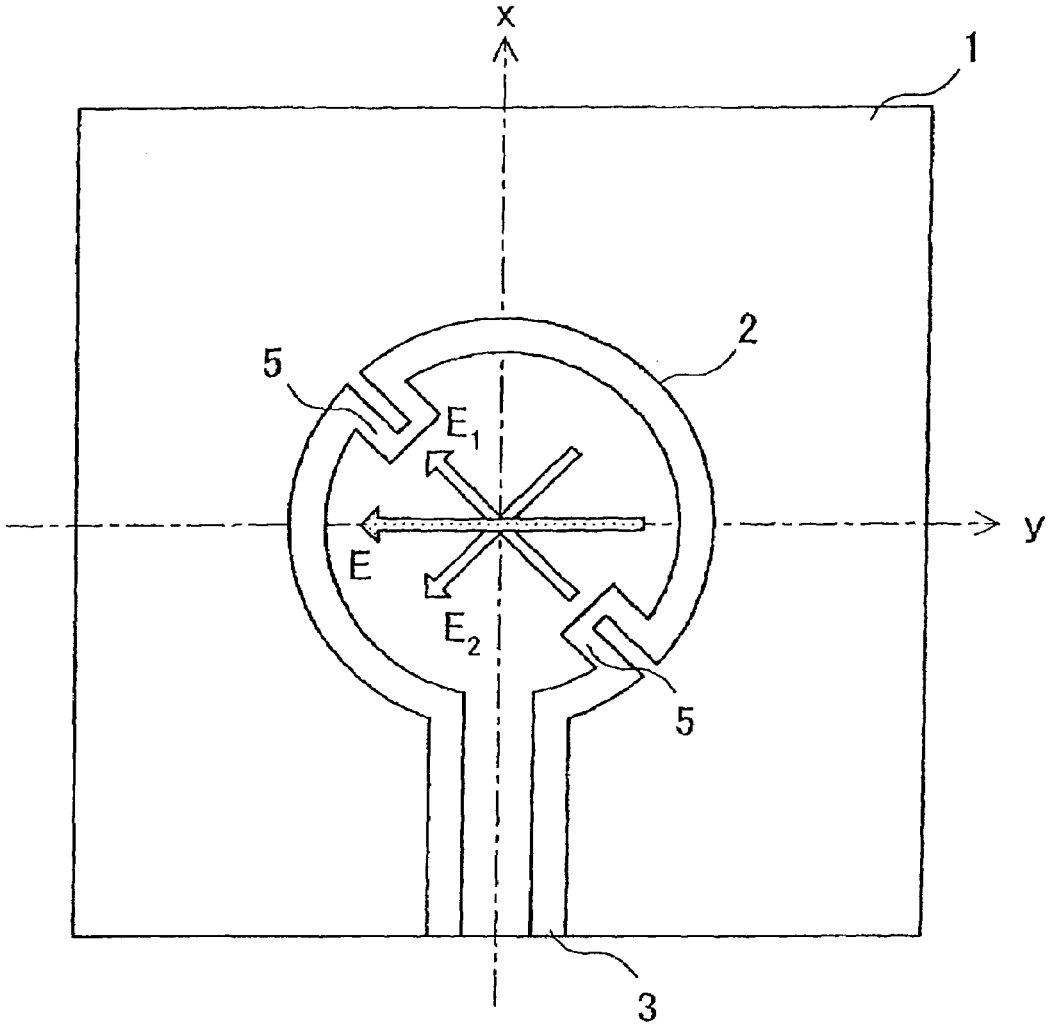
FIGS. 2A and 2B are a front view and a cross-sectional view showing the structure of a circularly polarized antenna in accordance with a variant of embodiment 1 of the present invention.
Figure 2B:
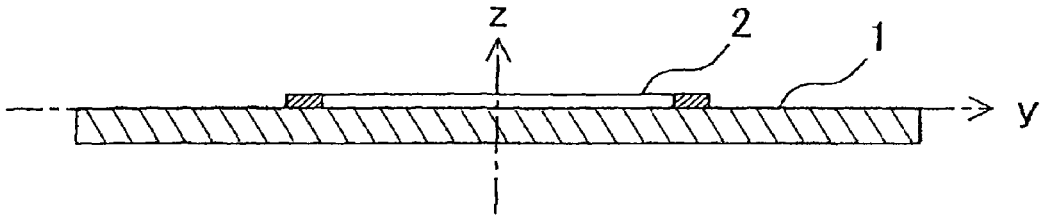

FIGS. 2A and 2B are views showing the structure of a circularly polarized antenna in accordance with a variant of embodiment 1 of the present invention. FIG. 2A is a front view of the circularly polarized antenna, and FIG. 2B is a cross-sectional view of the circularly polarized antenna. In FIG. 2A, reference numeral 5 denotes a perturbation element in the shape of a crank. In FIGS. 2A and 2B, the same reference numerals as shown in FIGS. 1A and 1B denote the same components or units as those of this embodiment 1 shown in FIGS. 1A and 1B or like components or units.

Each of the two perturbation elements 5 shown in FIG. 2A is a crank-shaped member in which a cut extending from the perimeter to the center of the loop antenna unit 2 is formed in the corresponding perturbation element 4 shown in FIG. 1A. The two perturbation elements 5 are arranged at two opposite points in the loop antenna unit 2 so that they are opposite to each other with the center of the loop antenna unit 2 being sandwiched by the two perturbation elements 5, like the two perturbation elements 4 of FIG. 1. Since each of the two perturbation elements 5 is thus shaped like a crank, the electrical length of the loop antenna unit 2 can be increased, and therefore the outer diameter of the loop antenna unit 2 shown in FIG. 2 can be further reduced at the same frequency as compared with the loop antenna unit 2 shown in FIG. 1.

Figure 3A:
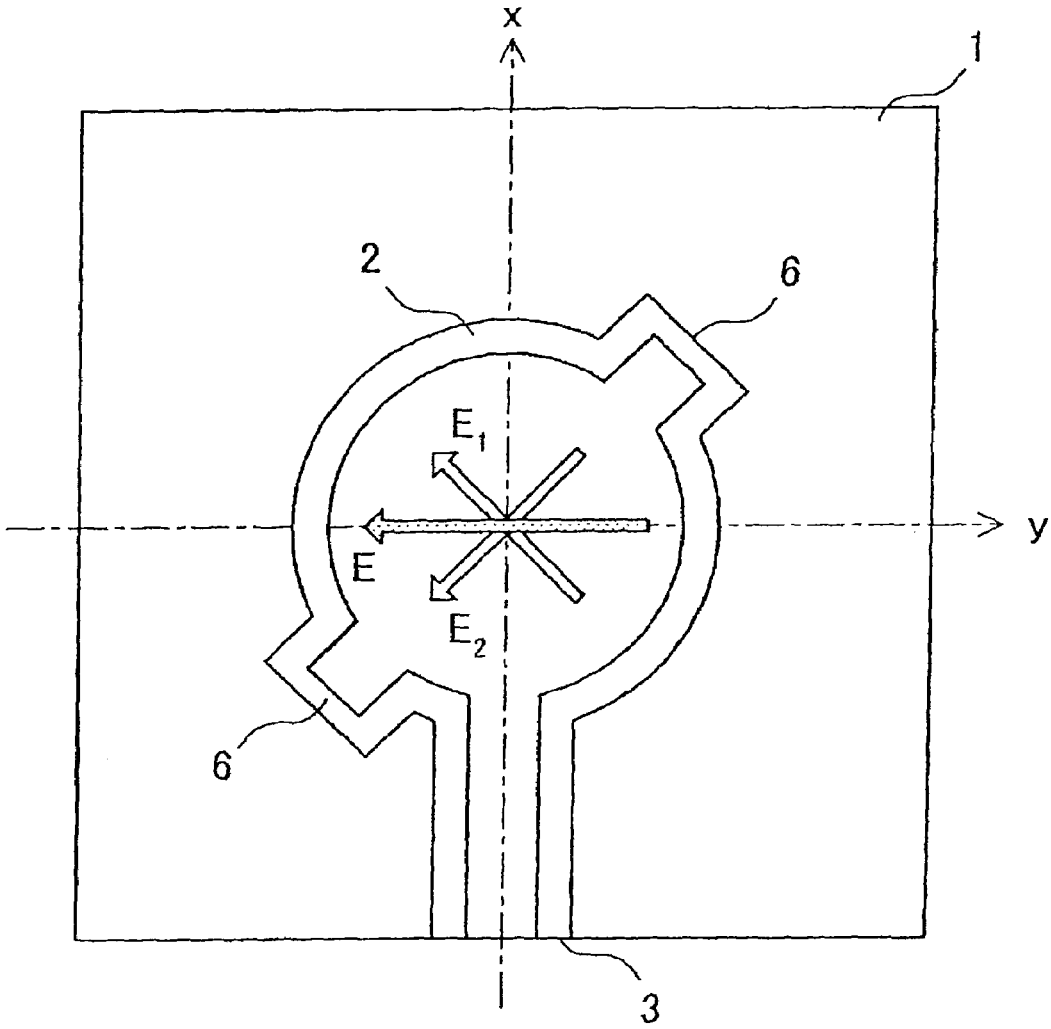
FIGS. 3A and 3B are a front view and a cross-sectional view showing the structure of a circularly polarized antenna in accordance with another variant of embodiment 1 of the present invention.
Figure 3B:
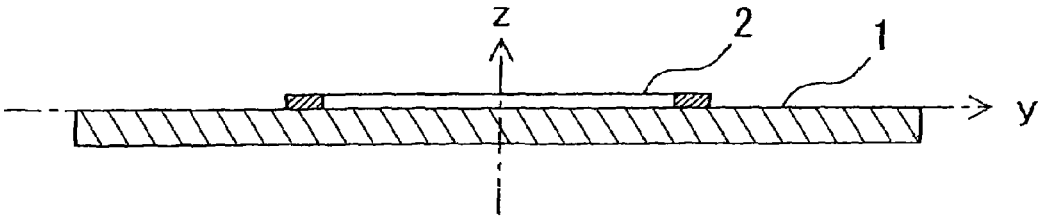

FIGS. 3A and 3B are views showing the structure of a circularly polarized antenna in accordance with another variant of embodiment 1 of the present invention. FIG. 3A is a front view of the circularly polarized antenna, and FIG. 3B is a cross-sectional view of the circularly polarized antenna. In FIG. 3A, reference numeral 6 denotes a perturbation element in the shape of a crank. In FIGS. 3A and 3B, the same reference numerals as shown in FIGS. 1A and 1B denote the same components or units as those of this embodiment 1 shown in FIGS. 1A and 1B or like components or units.

Each of the two perturbation elements 6 is a member in the shape of a crank which is inclined 45 degrees against a power feeding direction in which electric power is fed into the loop antenna unit 2 via the balanced line 3 (i.e., the direction of the X-axis) and which is projecting from the loop antenna unit 2 in a direction opposite to the inward direction toward the center of the loop antenna unit 2 (i.e., an outward direction from the loop antenna unit 2). The two perturbation elements 6 are arranged at two opposite points in the loop antenna unit 2 so that they are opposite to each other. In accordance with this variant, the provision of the two perturbation elements 6 causes an electric field having two components E1 and E2 in the loop antenna unit 2. As a result, circularly-polarized-wave radiation can be created. By properly setting the size and width of each of the two perturbation elements 6, the size (i.e., the height of each crank-shaped member) being defined with respect to the outward direction from the loop antenna unit 2, the two components E1 and E2 can become equal and can have a phase difference of 90 degrees between them. The electrical length of the loop antenna unit 2 can be increased by the provision of the two crank-shaped perturbation elements 6, as in the case of FIGS. 2A and 2B.

Figure 4A:
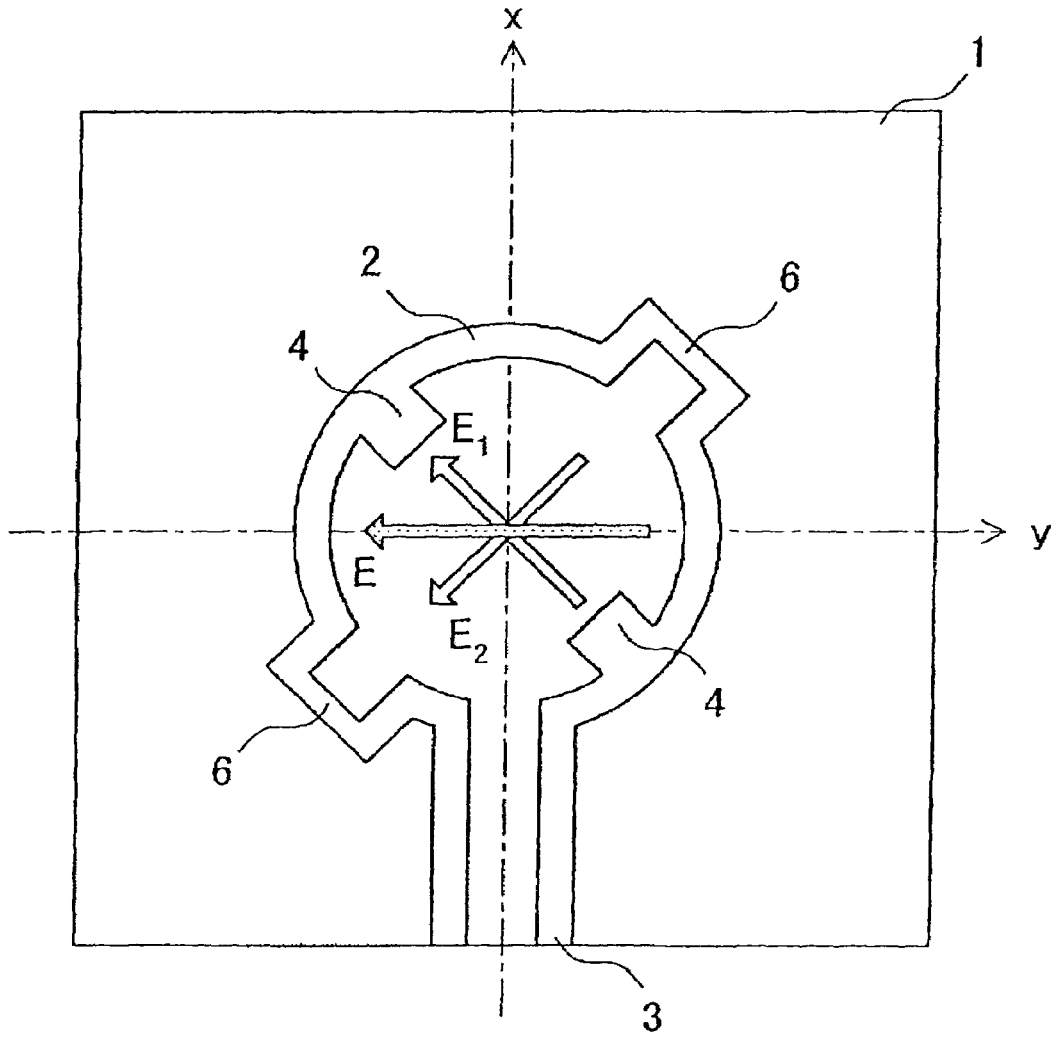
FIGS. 4A and 4B are a front view and a cross-sectional view showing the structure of a circularly polarized antenna in accordance with a further variant of embodiment 1 of the present invention.
Figure 4B:
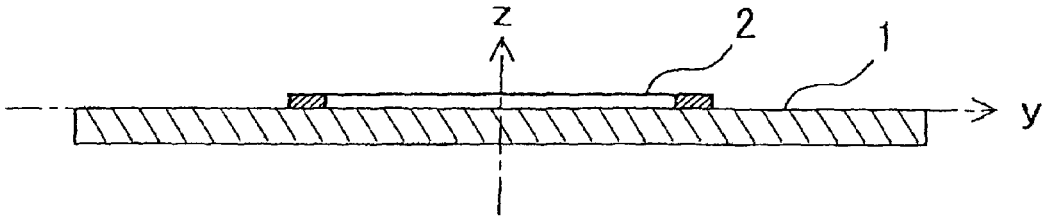

FIGS. 4A and 4B are views showing the structure of a circularly polarized antenna in accordance with a further variant of embodiment 1 of the present invention. FIG. 4A is a front view of the circularly polarized antenna, and FIG. 4B is a cross-sectional view of the circularly polarized antenna. In FIGS. 4A and 4B, the same reference numerals as shown in FIGS. 1A, 1B, 2A, 2B, 3A, and 3B denote the same components or units as those of this embodiment 1 shown in FIGS. 1A, 1B, 2A, 2B, 3A, and 3B or like components or units.

In accordance with this variant, two perturbation elements 4 and two perturbation elements 6 are disposed in the loop antenna unit 2 of the circularly polarized antenna, as shown in FIGS. 4A and 4B. This provision of the two perturbation elements 4 and the two perturbation elements 6 causes an electric field having two components E1 and E2 in the loop antenna unit 2. As a result, circularly-polarized-wave radiation can be created. By properly setting the size and width of each of the two perturbation elements 4 and the two perturbation elements 6, the two components E1 and E2 can become equal and can have a phase difference of 90 degrees between them.

Figure 5A:
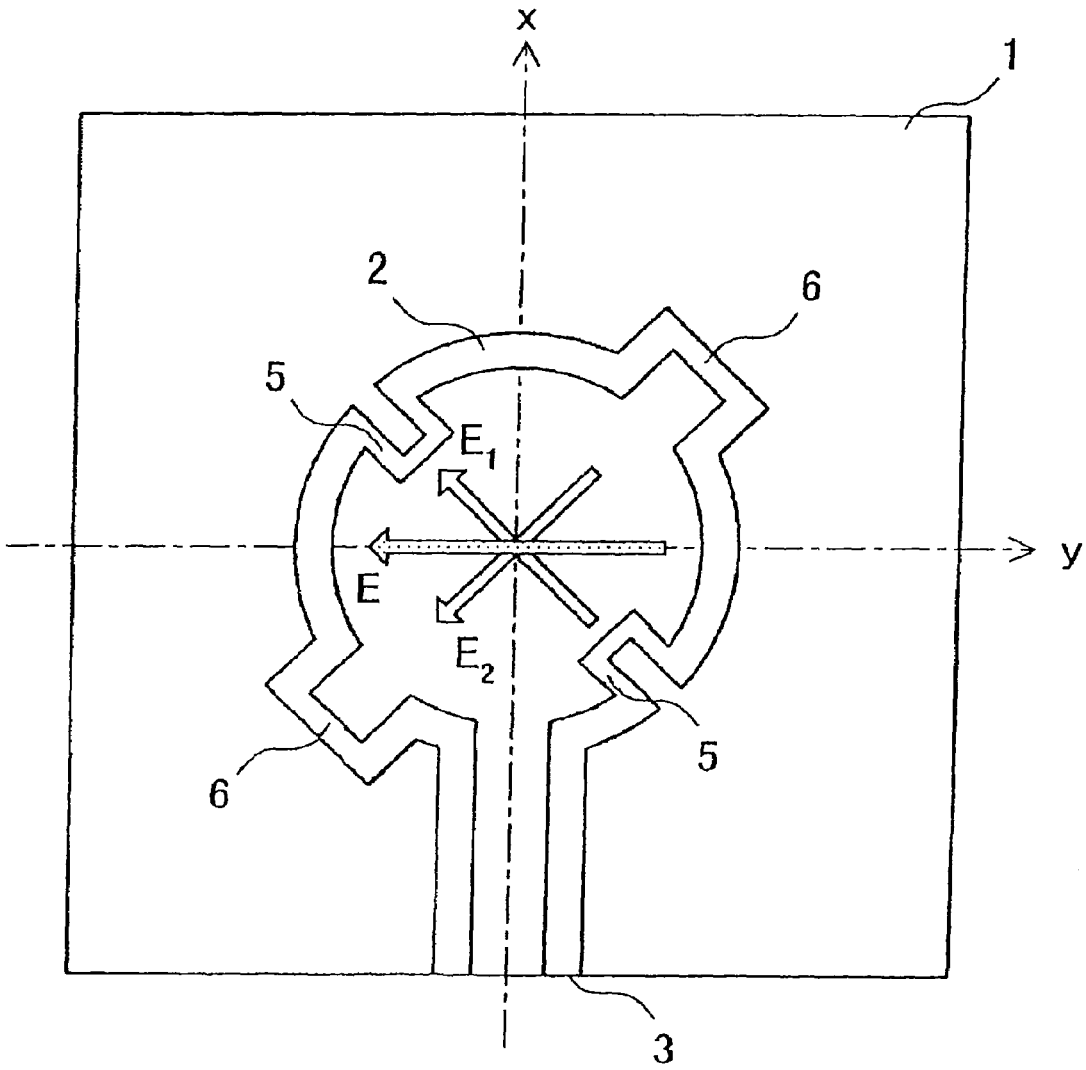
FIGS. 5A and 5B are a front view and a cross-sectional view showing the structure of a circularly polarized antenna in accordance with a still further variant of embodiment 1 of the present invention.
Figure 5B:
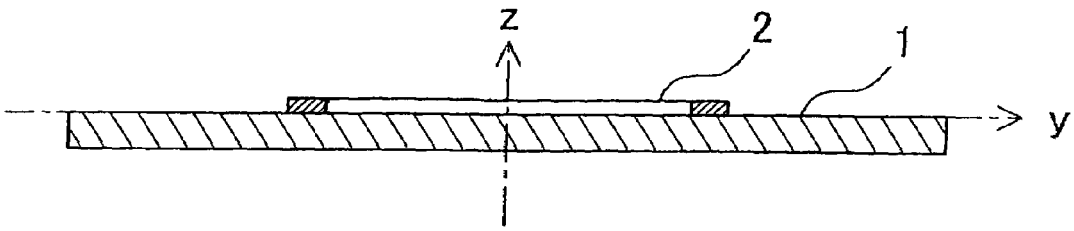

FIGS. 5A and 5B are views showing the structure of a circularly polarized antenna in accordance with a still further variant of embodiment 1 of the present invention. FIG. 5A is a front view of the circularly polarized antenna, and FIG. 5B is a cross-sectional view of the circularly polarized antenna. In FIGS. 5A and 5B, the same reference numerals as shown in FIGS. 1A, 1B, 2A, 2B, 3A, and 3B denote the same components or units as those of this embodiment 1 shown in FIGS. 1A, 1B, 2A, 2B, 3A, and 3B or like components or units.

In accordance with this variant, two perturbation elements 5 and two perturbation elements 6 are disposed in the loop antenna unit 2 of the circularly polarized antenna, as shown in FIGS. 5A and 5B. This provision of the two perturbation elements 5 and the two perturbation elements 6 causes an electric field having two components E1 and E2 in the loop antenna unit 2. As a result, circularly-polarized-wave radiation can be created. By properly setting the size and width of each of the two perturbation elements 5 and the two perturbation elements 6, the two components E1 and E2 can become equal and can have a phase difference of 90 degrees between them.

Embodiment 2

Figure 6:
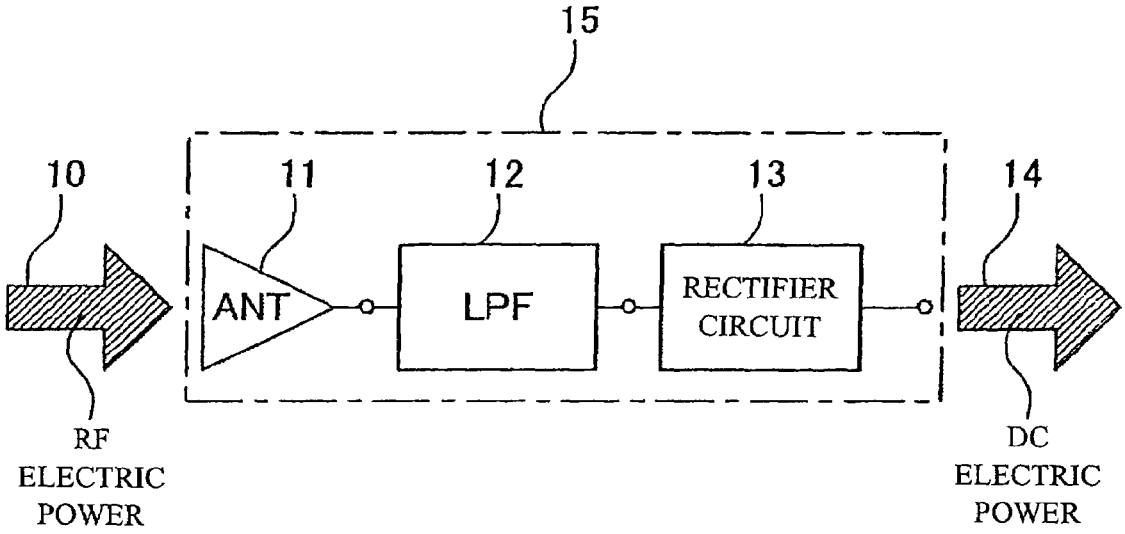
FIG. 6 is a block diagram showing the functionality of a rectenna element in accordance with embodiment 2 of the present invention.
Figure 7:
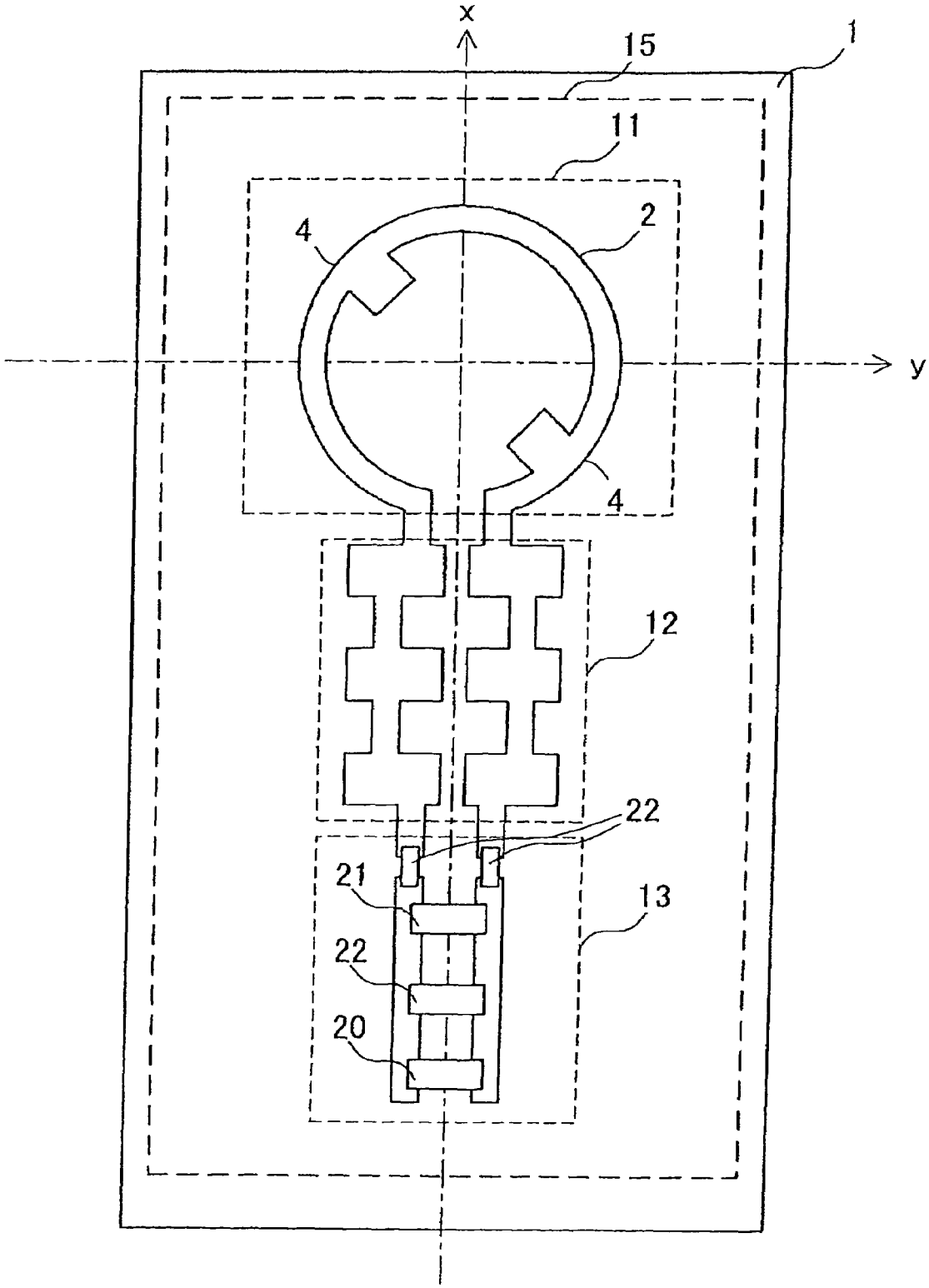
FIG. 7 is a view showing the structure of the rectenna element in accordance with embodiment 2 of the present invention.

A rectenna element in accordance with embodiment 2 of the present invention will be explained with reference to FIGS. 6 and 7. FIG. 6 is a functional block diagram showing the functionality of the rectenna element in accordance with embodiment 2 of the present invention. In FIG. 6, reference numeral 10 denotes a microwave (i.e., RF electric power) space transmitted to the rectenna element, reference numeral 11 denotes a loop antenna unit, reference numeral 12 denotes a low pass filter (referred to as an LPF 12 from here on), reference numeral 13 denotes a rectifier circuit, reference numeral 14 denotes DC electric power outputted from the rectifier circuit 13, and reference numeral 15 denotes the rectenna element in which the loop antenna unit 11, the LPF 12, and the rectifier circuit 13 are connected in series. FIG. 7 is a diagram showing the structure of the rectenna element in accordance with embodiment 2 of present invention. As shown in FIG. 7, the loop antenna unit 11, the LPF 12, and the rectifier circuit 13 are formed on one surface of a dielectric board 1. No ground conductor is disposed on the back surface of the dielectric board 1. In FIG. 7, reference numeral 20 denotes a resistor, reference numeral 21 denotes a diode, and reference numeral 22 denotes a capacitor. In FIG. 7, the same reference numerals as shown in FIGS. 1A and 1B denote the same components or units as those of this embodiment 1 shown in FIGS. 1A and 1B or like components or units.

The loop antenna unit 11 is equivalent to the loop antenna unit 2 as shown in FIGS. 1A, 2A, 3A, 4A, or 5A of embodiment 1, and creates circularly-polarized-wave radiation by means of two or more perturbation elements as shown in FIGS. 1A, 2A, 3A, 4A, or 5A. The loop antenna unit 11 shown in FIG. 7 has two perturbation elements 4 as shown in FIG. 1. The microwave (i.e., the RF electric power) 10 received by the loop antenna unit 11 is inputted into the rectifier circuit 13 via the LPF 12, and is converted into the DC electric power 14 by the rectifier circuit 13. The rectenna element 15 thus outputs the DC electric power 14. The LPF 12 filters out high-frequency components of the received RF electric power. The LPF 12 also filters out high-frequency components which are otherwise reradiated into space via the loop antenna unit 2 due to reflection of the received electric waves from the power supply side (i.e., the side of the rectifier circuit 13). From the viewpoint of only the function of receiving and converting the microwave (i.e., the RF electric power) 10 space transmitted to the rectenna element into the DC electric power 14, the LPF 12 can be omitted and the loop antenna unit 11 can be connected directly to the rectifier circuit 13.

The rectenna element shown in FIG. 7 is disposed on the front surface of the dielectric board 1, like the circularly polarized antenna shown in FIG. 1A, 2A, 3A, 4A, or 5A. Thus, no ground conductor is formed on the back surface of the dielectric board 1, and the loop antenna unit, the LPF 12, and the rectifier circuit 13 are formed on the front surface of the dielectric board 1. As a result, the structure of the rectenna element can be simplified and productivity can be increased. Thus, since no ground conductor is disposed on the back surface of the dielectric board 1, the thickness of the dielectric board 1 can be thinned. As previously explained in embodiment 1, when a thin-film board having a thickness ranging from dozens to hundreds of micrometers is used as the dielectric board 1, the weight of the rectenna element can be reduced.

Embodiment 3

Figure 8:
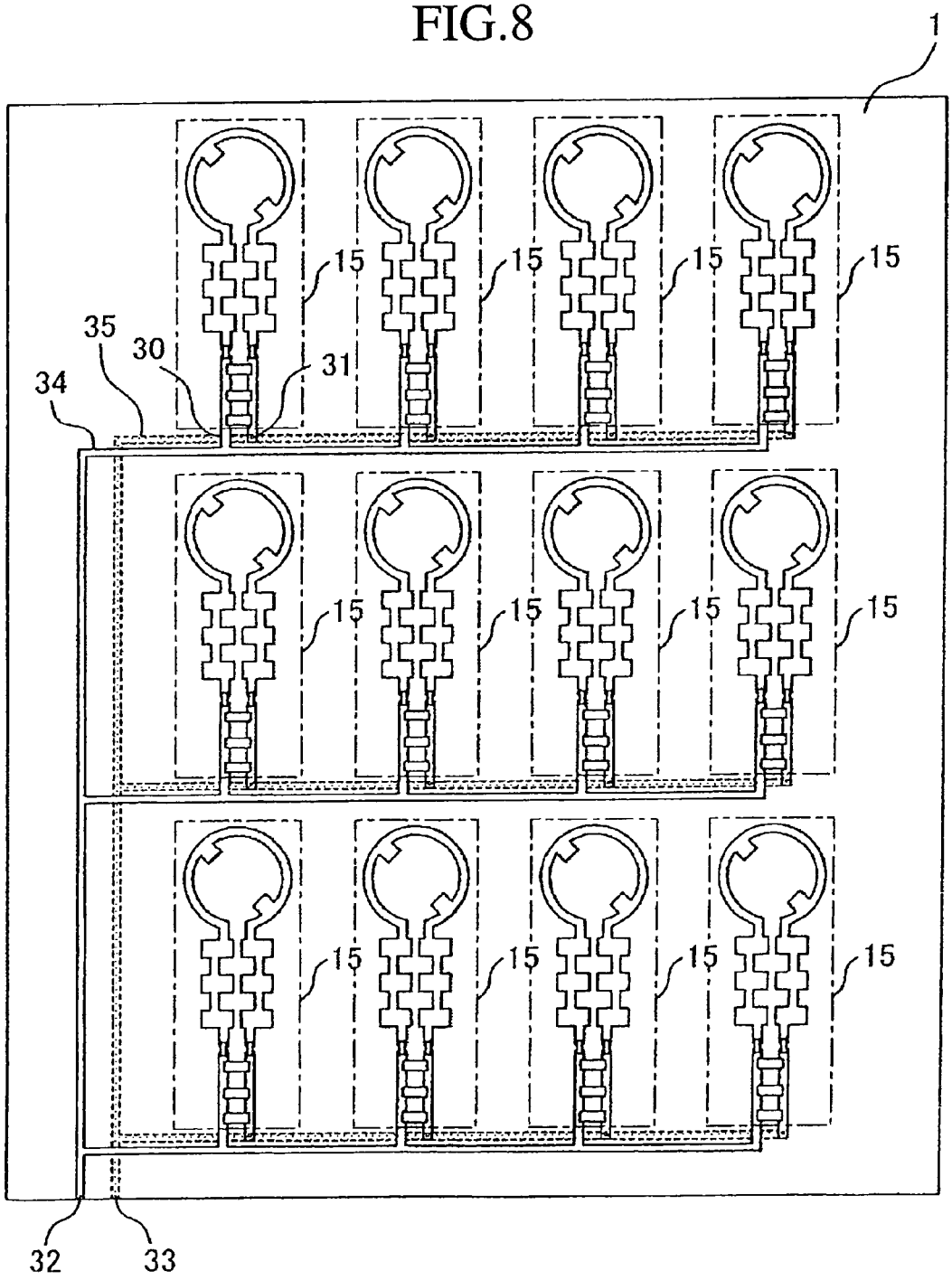
FIG. 8 is a view showing the structure of a rectenna in accordance with embodiment 3 of the present invention.

A rectenna in accordance with embodiment 3 of the present invention will be explained with reference to FIGS. 8 and 9. FIG. 8 is a view showing the structure of the rectenna in accordance with embodiment 3 of the present invention. In FIG. 8, reference numeral 30 denotes a positive input terminal of a rectifier circuit of each of a plurality of rectenna elements 15, reference numeral 31 denotes a positive input terminal of the rectifier circuit of each of a plurality of rectenna elements 15, reference numeral 32 denotes a positive power feeding terminal which is disposed for feeding electric power into the plurality of rectenna elements 15, reference numeral 33 denotes a negative power feeding terminal which is also disposed for feeding electric power into the plurality of rectenna elements 15, reference numeral 34 denotes a strip line that connects the positive input terminals 30 of the plurality of rectenna elements 15 with the positive power feeding terminal 32, and reference numeral 35 denotes another strip line that connects the negative input terminals 31 of the plurality of rectenna elements 15 with the negative power feeding terminal 33. Each of the plurality of rectenna elements 15 is equivalent to the rectenna element explained in embodiment 2 with reference to FIGS. 6 and 7.

As shown in FIG. 8, the plurality of rectenna elements 15 are arranged on the dielectric board 1 so that the rectenna has a large area. Each of the plurality of rectenna elements 15 can receive a microwave (i.e., RF electric power) space transmitted thereto by means of a loop antenna unit disposed therewithin. The loop antenna unit included in each of the plurality of rectenna elements 15 can receive a circularly-polarized wave by virtue of perturbation elements formed therein, as explained in embodiments 1 and 2. The microwave (i.e., the RF electric power) received by each of the plurality of rectenna elements 15 is rectified by a rectifier circuit disposed in each of the plurality of rectenna elements 15, and is outputted as DC electric power. The strip lines 34 and 35 of the rectenna connect the plurality of rectenna elements 15 with one another. The strip line 34 connects the positive input terminals 30 of the rectifier circuits of the plurality of rectenna elements 15 with one another and the strip line 35 connects the negative input terminals 31 of the rectifier circuits of the plurality of rectenna elements 15 with one another so that a combining circuit in which the plurality of rectenna elements 15 are connected in parallel with one another is formed. The strip line 35 is disposed on the back surface of the dielectric board 1. A through hole is formed in a part of the dielectric board 1 corresponding to the negative terminal 31 of the rectifier circuit of each of the plurality of rectenna elements 15 so that the negative terminal 31 is electrically connected to the strip line 35 via the through hole.

Figure 9:
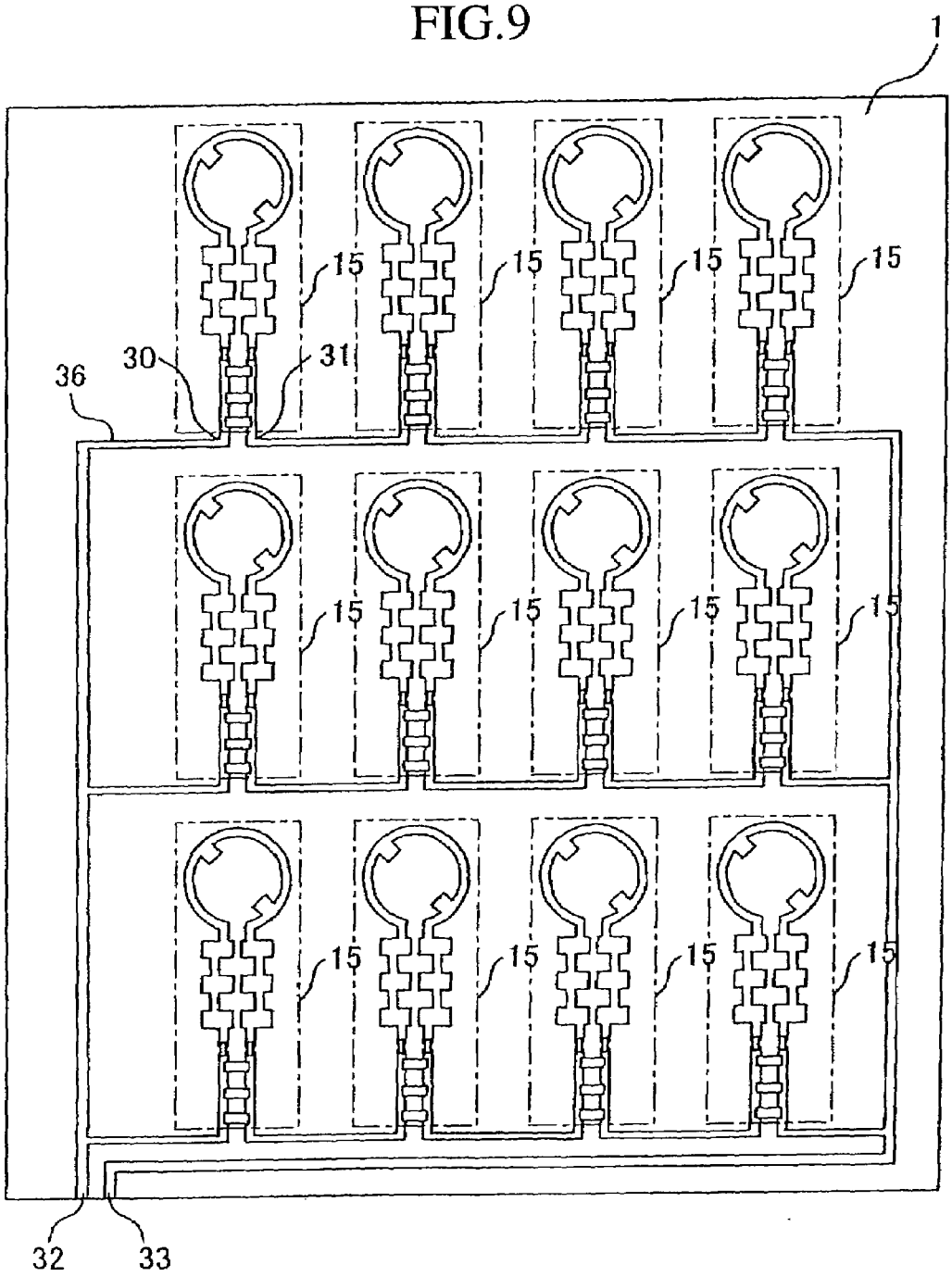
FIG. 9 is a view showing the structure of a rectenna in accordance with a variant of embodiment 3 of the present invention.

FIG. 9 is a block diagram showing the structure of a rectenna in accordance with a variant of embodiment 3 of the present invention. In FIG. 9, reference numeral 36 denotes a strip line that connects a plurality of rectenna elements included in each of plural sets in series. In other words, the strip line 36 connects the input terminals of the rectifier circuits of the plurality of rectenna elements 15 (in the case of FIG. 9, four rectenna elements) included in each of plural sets in series, and connects the plurality of sets in parallel with one another. This connection can form a pattern including the plurality of rectenna elements 15 and the strip line 36 on the front surface of the dielectric board 1.

In the rectenna formed as shown in each of FIGS. 8 and 9, there is no necessity to dispose any ground conductor on the back surface of the dielectric board 1, and the thickness of the dielectric board 1 can be thinned and therefore the weight of the rectenna can be reduced. Furthermore, since the rectenna can have a large-area opening, it is possible to prevent the whole of the rectenna from increasing in weight. The thinning and weight reduction of the rectenna make it possible to secure the rectenna to a wall of a structure such as an existing building.

Many widely different embodiments of the present invention may be constructed without departing from the spirit and scope of the present invention. It should be understood that the present invention is not limited to the specific embodiments described in the specification, except as defined in the appended claims.

What is claimed is:

1. A circularly polarized antenna comprising:

a dielectric board having first and second opposite surfaces;

a balanced line formed on a first surface of said dielectric board;

a loop antenna unit disposed on the first surface of said dielectric board, formed in a shape of a loop, and connected to said balanced line; and two perturbation elements each of which is formed in a shape of a tooth and is projecting from said loop antenna unit in an inward direction toward a center of said loop antenna unit, said two perturbation elements being arranged opposite to each other, wherein no ground plate is formed on the second surface of the dielectric board.

2. The circularly polarized antenna according to claim 1, wherein each of said two perturbation elements is shaped like a crank.

3. The circularly polarized antenna according to claim 1, wherein said dielectric board is a thin-film board.

4. The circularly polarized antenna according to claim 1, further comprising two other perturbation elements each of which is formed in a shape of a crank and is projecting from said loop antenna unit in an outward direction, said two other perturbation elements being arranged opposite to each other.

5. A circularly polarized antenna comprising:

a dielectric board having first and second opposite surfaces;

a balanced line formed on a first surface of said dielectric board;

a loop antenna unit disposed on the first surface of said dielectric board, formed in a shape of a loop, and connected to said balanced line; and two perturbation elements each of which is formed in a shape of a crank and is projecting from said loop antenna unit in an outward direction, said two perturbation elements being arranged opposite to each others, wherein no ground plate is formed on the second surface of the dielectric board.

6. A rectenna element comprising:

a dielectric board;

a loop antenna unit disposed on said dielectric board and formed in a shape of a loop;

two perturbation elements disposed in said loop antenna unit so that they are opposite to each other; and a rectifier circuit disposed on said dielectric board, for rectifying RF electric power received by said loop antenna unit.

7. The rectenna element according to claim 6, wherein said dielectric board is a thin-film board.

8. A rectenna comprising:

a dielectric board;

a plurality of rectenna elements each including a loop antenna unit disposed on said dielectric board and formed in a shape of a loop, two perturbation elements disposed in said loop antenna unit so that they are opposite to each other, and a rectifier circuit disposed on said dielectric board, for rectifying RF electric power received by said loop antenna unit; and a combining circuit having a strip line that connects positive inputs of the rectifier circuits of said plurality of rectenna elements with one another, and another strip line that connects negative inputs of the rectifier circuits of said plurality of rectenna elements with one another, for connecting said plurality of rectenna elements in parallel with one another.

9. A rectenna comprising:

a dielectric board;

a plurality of rectenna elements each including a loop antenna unit disposed on said dielectric board and formed in a shape of a loop, two perturbation elements disposed in said loop antenna unit so that they are opposite to each other, and a rectifier circuit disposed on said dielectric board, for rectifying RF electric power received by said loop antenna unit; and a combining circuit for connecting the rectifier circuits of said plurality of rectenna elements in series.

10. A circularly polarized antenna comprising:

a dielectric board;

a balanced line formed on a surface of said dielectric board;

a loop antenna unit disposed on the surface of said dielectric board, formed in a shape of a loop, and connected to said balanced line;

two perturbation elements each of which is formed in a shape of a tooth and is projecting from said loop antenna unit in an inward direction toward a center of said loop antenna unit, said two perturbation elements being arranged opposite to each other; and two other perturbation elements each of which is formed in a shape of a crank and is projecting from said loop antenna unit in an outward direction, said two other perturbation elements being arranged opposite to each other.

11. The circularly polarized antenna according to claim 10, wherein each of said two perturbation elements is shaped like a crank.

12. The circularly polarized antenna according to claim 10, wherein said dielectric board is a thin-film board.

* * * * *